US007214649B2

(12) United States Patent
Loper et al.

(10) Patent No.: US 7,214,649 B2
(45) Date of Patent: May 8, 2007

(54) HYDROCARBYL DISPERSANTS INCLUDING PENDANT POLAR FUNCTIONAL GROUPS

(75) Inventors: John T. Loper, Richmond, VA (US); Roger M. Sheets, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 560 days.

(21) Appl. No.: 10/749,276

(22) Filed: Dec. 31, 2003

(65) Prior Publication Data

US 2005/0143265 A1 Jun. 30, 2005

(51) Int. Cl.
*C10M 133/16* (2006.01)
*C10M 133/44* (2006.01)

(52) U.S. Cl. ..... 508/232; 508/291

(58) Field of Classification Search ..... 508/291, 508/232

See application file for complete search history.

(56) References Cited

U.S. PATENT DOCUMENTS

| | | | |
|---|---|---|---|
| 2,459,112 | A | 1/1949 | Oberright |
| 2,962,442 | A | 11/1960 | Andress, Jr. |
| 2,984,550 | A | 5/1961 | Charnot |
| 3,036,003 | A | 5/1962 | Verdol |
| 3,166,516 | A | 1/1965 | Kirkpatrick et al. |
| 3,236,770 | A | 2/1966 | Matson et al. |
| 3,329,658 | A | 7/1967 | Fields |
| 3,368,972 | A | 2/1968 | Otto |
| 3,413,347 | A | 11/1968 | Worrell |
| 3,442,808 | A | 5/1969 | Traise et al. |
| 3,448,047 | A | 6/1969 | Traise et al. |
| 3,449,250 | A | 6/1969 | Fields |
| 3,454,497 | A | 7/1969 | Wittner |
| 3,459,661 | A | 8/1969 | Schlobohm |
| 3,493,520 | A | 2/1970 | Verdol et al. |
| 3,519,565 | A | 7/1970 | Coleman |
| 3,539,633 | A | 11/1970 | Piasek et al. |
| 3,558,743 | A | 1/1971 | Verdol et al. |
| 3,586,629 | A | 6/1971 | Otto et al. |
| 3,591,598 | A | 7/1971 | Traise et al. |
| 3,600,372 | A | 8/1971 | Udelhofen et al. |
| 3,634,515 | A | 1/1972 | Piasek et al. |
| 3,649,229 | A | 3/1972 | Otto |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrell |
| 3,725,480 | A | 4/1973 | Traise et al. |
| 3,726,882 | A | 4/1973 | Traise et al. |
| 3,736,357 | A | 5/1973 | Piasek et al. |
| 3,736,535 | A | 5/1973 | Mohr et al. |
| 3,751,365 | A | 8/1973 | Piasek et al. |
| 3,756,953 | A | 9/1973 | Piasek et al. |
| 3,793,202 | A | 2/1974 | Piasek et al. |
| 3,798,165 | A | 3/1974 | Piasek et al. |
| 3,798,247 | A | 3/1974 | Piasek et al. |
| 3,803,039 | A | 4/1974 | Piasek et al. |
| 3,872,019 | A | 3/1975 | Culbertson et al. |
| 3,904,595 | A | 9/1975 | Plonsker et al. |
| 3,957,746 | A | 5/1976 | Malec |
| 3,980,569 | A | 9/1976 | Pindar et al. |
| 3,985,802 | A | 10/1976 | Piasek et al. |
| 4,006,089 | A | 2/1977 | Chibnik |
| 4,011,380 | A | 3/1977 | West et al. |
| 4,025,451 | A | 5/1977 | Plonsker et al. |
| 4,058,468 | A | 11/1977 | Malec |
| 4,083,699 | A | 4/1978 | Chibnik |
| 4,090,854 | A | 5/1978 | Davis |
| 4,092,255 | A | 5/1978 | Chapelet et al. |
| 4,146,489 | A | 3/1979 | Stambaugh et al. |
| 4,170,561 | A | 10/1979 | Chapelet et al. |
| 4,334,085 | A | 6/1982 | Basalay et al. |
| 4,354,950 | A | 10/1982 | Hammond et al. |
| 4,485,023 | A | 11/1984 | Serres et al. |
| 4,554,086 | A * | 11/1985 | Karol et al. ..... 508/192 |
| 4,732,942 | A | 3/1988 | Liu et al. |
| 4,769,043 | A | 9/1988 | Kapusciniski et al. |
| 4,810,754 | A | 3/1989 | McCrary |
| 4,863,623 | A | 9/1989 | Nalesnik |
| 4,941,985 | A | 7/1990 | Benfaremo et al. |

(Continued)

FOREIGN PATENT DOCUMENTS

WO WO 9612746 A1 * 5/1996

OTHER PUBLICATIONS

Pirro, D. M., and Wessol, A. A., Lubrication Fundamentals, 2001, Marcel Dekker, Second Edition, p. 22.*

*Primary Examiner*—Vasu Jagannathan
*Assistant Examiner*—James Goloboy
(74) *Attorney, Agent, or Firm*—MH2 Technology Law Group

(57) ABSTRACT

A dispersant composition for use as a lubricant additive. The dispersant composition includes a reaction product of an acrylamide and a compound having at least one primary or secondary amine group and being selected from the group consisting of hydrocarbyl-substituted succinimides, hydrocarbyl-substituted amines, and Mannich base adducts derived from hydrocarbyl-substituted phenols condensed with aldehydes and amines. The hydrocarbyl substituent has a number average molecular weight ranging from about 500 to about 5000 as determined by gel permeation chromatography.

31 Claims, No Drawings

U.S. PATENT DOCUMENTS 5,071,919 A 12/1991 DeGonia et al.
5,075,383 A 12/1991 Migdal et al.
5,112,508 A 5/1992 DeRosa et al.
5,186,853 A 2/1993 Carlisle
5,238,588 A 8/1993 Nalesnik et al.
5,294,354 A 3/1994 Papke et al.
5,397,489 A * 3/1995 Carlisle ..... 508/494
5,433,875 A 7/1995 Rollin et al.
5,439,603 A 8/1995 Carlisle
5,523,008 A 6/1996 Boden et al.
5,652,201 A * 7/1997 Papay et al. ..... 508/228
5,663,126 A 9/1997 Boden et al.
5,811,377 A * 9/1998 Watts et al. ..... 508/188
5,814,586 A 9/1998 Boden et al.
5,843,874 A 12/1998 Macpherson et al.
5,888,947 A * 3/1999 Lambert et al. ..... 508/491
6,107,257 A 8/2000 Valcho et al.
6,187,721 B1 2/2001 Goldblatt et al.
6,255,261 B1 * 7/2001 Liesen et al. ..... 508/469
6,350,723 B1 * 2/2002 Mishra et al. ..... 508/472
6,472,353 B1 10/2002 Smoggie et al.
6,548,606 B1 * 4/2003 De Groot et al. ..... 525/332.7

* cited by examiner

HYDROCARBYL DISPERSANTS INCLUDING PENDANT POLAR FUNCTIONAL GROUPS

TECHNICAL FIELD

The following disclosure is directed to dispersants for lubricant applications, crankcase dispersants, crankcase lubricant compositions and methods for improving engine performance using novel lubricant compositions.

BACKGROUND

Dispersants are important additives for lubricant compositions. Dispersants maintain impurities and deposits in a suspended state so that they can be removed from the system by filtration or other means rather than being deposited on internal engine components, gears, and transmissions.

Of the dispersants commonly used in lubricant applications, polymeric Mannich base additives, hydrocarbyl amine adducts, and hydrocarbyl succinic acid derivatives provide desirable properties for such applications. Mannich base dispersants are typically produced by reacting alkyl-substituted phenols with aldehydes and amines, such as is described in U.S. Pat. Nos. 3,539,633; 3,697,574; 3,704,308; 3,736,535; 3,736,357; 4,334,085; and 5,433,875.

Hydrocarbyl succinic acid based dispersants are derived by alkylating, for example, maleic anhydride, acid, ester or halide with an olefinic hydrocarbon to form an acylating agent as described in U.S. Pat. No. 5,071,919.

Despite the wide variety of dispersants available for lubricant applications, there remains a need for improved dispersants for gear and transmission lubricants and particularly for crankcase lubricant applications.

SUMMARY OF THE EMBODIMENTS

In one embodiment herein is presented a modified dispersant for use as a lubricant additive, a lubricant composition and a method for improving engine, gear or transmission performance. The modified dispersant includes a reaction product of (1) an acrylamide and (2) a dispersant having at least one primary or secondary amine group and a hydrocarbyl group having a number average molecular weight ranging from about 500 to about 5000 as determined by gel permeation chromatography.

In another embodiment there is provided a lubricant additive composed of a reaction product of (1) an acrylamide and (2) a dispersant including a member selected from the group hydrocarbyl-substituted succinimides, hydrocarbyl-substituted amines, and Mannich base adducts derived from hydrocarbyl-substituted phenols condensed with aldehydes and amines. The hydrocarbyl substituent has a number average molecular weight ranging from about 500 to about 5000 as determined by gel permeation chromatography.

In yet another embodiment, a method of reducing engine deposits in an internal combustion engine of a vehicle is provided. The method includes using, as a crankcase lubricating oil for the internal combustion engine, a lubricant composition containing a lubricant and a lubricant additive. The lubricant additive includes a reaction product of (1) an acrylamide and (2) a dispersant including a member selected from the group hydrocarbyl-substituted succinimides, hydrocarbyl-substituted amines, and Mannich base adducts derived from hydrocarbyl-substituted phenols condensed with aldehydes and amines. The hydrocarbyl substituent has a number average molecular weight ranging from about 500 to about 5000 as determined by gel permeation chromatography.

An advantage of the embodiments described herein is that it provides improved dispersants for lubricant compositions, lubricant compositions containing the improved dispersants, and methods for improving engine, gear or transmission performance using the improved dispersants. Dispersants in the lubricating oil suspend thermal decomposition and oxidation products, such as soot and sludge, and reduce or retard the formation of deposits on lubricated surfaces. Dispersants provided according to the following disclosure have been observed to exhibit an increased polar functionality for association with sludge while remaining substantially dissolved in an oleaginous fluid.

The dispersants described herein are particularly suitable for crankcase lubricants for diesel and gasoline engines, as dispersants for automatic or manual transmission fluids, as additives for continuously variable gear oils, and as a component of hydraulic oils. Other features and advantages of the of the dispersants will be evident by reference to the following detailed description which is intended to exemplify aspects of the preferred embodiments without intending to limit the embodiments described herein.

DETAILED DESCRIPTION OF THE PREFERRED EMBODIMENTS

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Examples of hydrocarbyl groups useful herein include but are not limited to:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical) and equivalents thereof;

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy) and equivalents thereof;

(3) hetero-substituents, that is, substituents which, while having a predominantly hydrocarbon character, in the context of this description, contain other than carbon in a ring or chain otherwise composed of carbon atoms and equivalents thereof. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Of the hydrocarbyl substituents, olefinic hydrocarbons are particularly preferred for the hydrocarbyl substituent of at least one dispersant. Olefinic hydrocarbons such as isobutene are typically made by cracking a hydrocarbon stream to produce a hydrocarbon mixture of essentially $C_4$-hydrocarbons. For example, thermocracking processes (streamcracker) produce $C_4$ cuts comprising $C_4$ paraffins and $C_4$ olefins, with a major component being isobutene.

Improved dispersants for lubricants are provided according to the disclosure by reacting an acrylamide with an amine containing dispersant. The amine containing dispersant in an embodiment contains at least one primary or secondary amine for reaction with the acrylamide. For purposes of the disclosure herein, the acrylamide may be represented by the following formula:

(1)

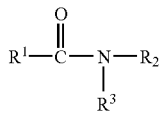

where $R^1$ is selected from an α,β-unsaturated linear or branched alkylene group, and $R^2$ and $R^3$ are independently selected from H, a branched or linear alkyl or alkenyl group, an aryl group, a cycloalkyl group, an aralkyl group, an alkyaryl group, an alkyl amine group, and an aryl amine group, provided that at least one of $R^2$ and $R^3$ contain a titratable nitrogen.

A preferred acrylamide for reaction with an amine containing dispersant may be represented by the following formula:

(2)

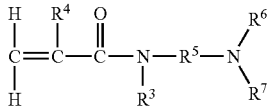

where $R^4$ is selected from H, and an alkyl group containing from 1 to 4 carbon atoms, $R^3$ is selected from H, an alkyl or alkenyl group containing from one to thirty carbon atoms, and an aryl group, $R^5$ is selected from an alkylene group, an aralkylene group, a cycloalkylene group, an arylene group, and an alkarylene group, and $R^6$ and $R^7$ are independently selected from H, a branched or linear alkyl or alkenyl group, an aryl group, an aralkyl group, a cycloalkyl group, and an alkaryl group.

In the above formula (2), when $R^6$ or $R^7$ is alkyl, each may typically be methyl, ethyl, n-propyl, isopropyl, n-butyl, isobutyl, sec-butyl, amyl, octyl, decyl, octadecyl and the like. When $R^6$ or $R^7$ is aralkyl, it may typically be benzyl, betaphenylethyl and the like. When $R^6$ or $R^7$ is cycloalkyl, it may typically be cyclohexyl, cycloheptyl, cyclooctyl, 2-methylcycloheptyl, 3-butylcyclohexyl, 1,3-methylcyclohexyl, and the like. When $R^6$ or $R^7$ is alkaryl, it may typically be tolyl, xylyl, and the like. $R^6$ or $R^7$ may be inertly substituted, i.e., it may bear a non-reactive substituent such as alkyl, aryl, cycloalkyl, ether, and the like. Typically, inertly substituted $R^6$ or $R^7$ groups may include 2-ethoxyethyl, carboethoxymethyl, 4-methyl cyclohexyl, and the like. The preferred $R^6$ or $R^7$ groups may be lower alkyl, i.e., $C_1$–$C_{10}$ alkyl groups including e.g., methyl, ethyl, n-propyl, i-propyl, butyl, amyl, hexyl, octyl, decyl, and the like.

As disclosed above, $R^5$ may be selected from an alkylene group, an aralkylene group, a cycloalkylene group, an arylene group, and an alkarylene group. When $R^5$ is an alkylene group, it may typically be methylene, ethylene, n-propylene, iso-propylene, n-butylene, i-butylene, sec-butylene, octylene, decylene, octadecylene, and the like. When $R^5$ is an aralkylene group, it may typically be benzylene, beta-phenylethylene, and the like. When $R^5$ is a cycloalkylene group, it may typically be cyclohexylene, cycloheptylene, cyclooctylene, 2-methylcycloheptylene, 3-butylcyclohexylene, 3-methylcyclohexylene, and the like. $R^5$ may also be inertly substituted, i.e., it may bear a non-reactive substituent such as alkyl, aryl, cycloalkyl, ether, and the like. Typically, inertly substituted $R^5$ groups may include 2-ethoxyethylene, carboethoxymethylene, 4-methyl cyclohexylene, and the like. The preferred $R^5$ groups may be lower alkylene, i.e., $C_1$–$C_{10}$ alkylene, groups including e.g., methylene, ethylene, n-propylene, i-propylene, butylene, amylene, hexylene, octylene, decylene, and the like. $R^5$ is preferably propylene (—$CH_2CH_2CH_2$—). Representative of the compounds of formula (2) include N,N-dimethylaminopropylmethacrylamide, N,N-diethylaminopropylmethacrylamide and N,N-dimethylaminoethylacrylamide.

The other component used to make the modified dispersants according to the invention is a conventional amine containing dispersant. The amine containing dispersant preferably has at least one primary or secondary amine available to react with the acrylamide component. Suitable dispersants may be selected from hydrocarbyl-substituted succinimides, hydrocarbyl-substituted amines, and Mannich base adducts derived from hydrocarbyl-substituted phenols condensed with aldehydes and amines. The hydrocarbyl substituent of the dispersant preferably has a number average molecular weight ranging from about 500 to about 5000 as determined by gel permeation chromatography.

Hydrocarbyl-substituted succinic acylating agents are used to make hydrocarbyl-substituted succinimides. The hydrocarbyl-substituted succinic acylating agents include, but are not limited to, hydrocarbyl-substituted succinic acids, hydrocarbyl-substituted succinic anhydrides, the hydrocarbyl-substituted succinic acid halides (especially the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents. Of these compounds, the hydrocarbyl-substituted succinic acids and the hydrocarbyl-substituted succinic anhydrides and mixtures of such acids and anhydrides are useful, and in one embodiment the hydrocarbyl-substituted succinic anhydrides are employed.

Hydrocarbyl-substituted acylating agents are made by reacting a polyolefin of appropriate molecular weight (with or without chlorine) with maleic anhydride. Similar carboxylic reactants can be used to make the acylating agents. Such reactants include, but are not limited to, maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

Hydrocarbyl-substituted succinic anhydrides are conventionally prepared by methods well known to those in the art.

The mole ratio of maleic or succinic anhydride to olefin useful herein can vary widely. It may vary, for example, from 0.5:1 to 5:1, a more preferred range is 0.5:1 to 4:1. With olefins such as polyisobutylene having a number average molecular weight of 500 to 5000, preferably 800 to 3000 or higher and the ethylene-alpha-olefin copolymers, the maleic anhydride is preferably used in a ratio of anhydride to olefin ranging from about 0.8:1 to about 4:1 moles maleic anhydride per mole of olefin. The unreacted maleic anhydride can be vaporized from the resultant reaction mixture.

The hydrocarbyl-substituted succinic anhydrides include polyalkyl or polyalkenyl succinic anhydrides prepared by the reaction of maleic anhydride with the desired polyolefin or chlorinated polyolefin, under reaction conditions well known in the art.

Polyalkenyl succinic anhydrides may be converted to polyalkyl succinic anhydrides by using conventional reducing conditions such as catalytic hydrogenation.

Dispersants may be prepared, for example, by reacting the hydrocarbyl-substituted succinic acids or anhydrides with an amine. Preferred amines are selected from polyamines and hydroxyamines. Examples of polyamines that may be used include, but are not limited to, aminoguanidine bicarbonate (AGBC), diethylene triamine (DETA), triethylene tetramine (TETA), tripropylene tetramine (TPTA), tetraethylene pentamine (TEPA), pentaethylene hexamine (PEHA) and heavy polyamines.

A heavy polyamine is a mixture of polyalkylenepolyamines comprising small amounts of lower polyamine oligomers such as TEPA and PEHA but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120–160 grams per equivalent.

Commercially available polyamines are commonly known as PAM, and contain a mixture of ethylene amines where TEPA and pentaethylene hexamine (PEHA) are the major part of the polyamine, usually less than about 80%. PAM is commercially available from suppliers such as Huntsman Chemical under the trade name E-100 or from the Dow Chemical Company under the trade name HPA-X. The commercially available PAM mixture typically consists of less than 1.0 wt. % low molecular weight amine, 10–15 wt. % TEPA, 40–50 wt. % PEHA and the balance hexaethyleneheptamine (HEHA) and higher oligomers. Typically PAM has 8.7–8.9 milliequivalents of primary amine per gram (an equivalent weight of 115 to 112 grams per equivalent of primary amine) and a total nitrogen content of about 33–34 wt. %.

Heavier cuts of PAM oligomers with practically no TEPA and only very small amounts of PEHA but containing primarily oligomers with more than 6 nitrogens and more extensive branching, produce dispersants with improved dispersancy. An example of one of these heavy polyamine compositions is commercially available from the Dow Chemical Company under the trade name of Polyamine HA-2.

HA-2 is prepared by distilling out the lower boiling polyethylene amine oligomers (light ends) including TEPA. The TEPA content is less than 1 wt. %. Only a small amount of PEHA, less than 25 wt. %, usually 5–15 wt. %, remains in the mixture. The balance is higher nitrogen content oligomers usually with a greater degree of branching. The heavy polyamine as used herein is preferably devoid of oxygen atoms.

Typical analysis of HA-2 gives primary nitrogen values of about 7.8 milliequivalents (meq) (e.g. 7.7–7.8) of primary amine per gram of polyamine. This calculates to be about an equivalent weight (EW) of 128 grams per equivalent (g/eq). The total nitrogen content is about 32.0–33.0 wt. %. Commercial PAM analyzes for 8.7–8.9 meq of primary amine per gram of PAM and a nitrogen content of about 33 to about 34 wt. %.

Other polyamines that are also suitable in preparing the dispersants described herein include N-arylphenylenediamines, such as N-phenylphenylenediamines, for example, N-phenyl-1,4-phenylenediamine, N-phenyl-1,3-phenylendiamine, and N-phenyl-1,2-phenylenediamine; aminothiazoles such as aminothiazole, aminobenzothiazole, aminobenzothiadiazole and aminoalkylthiazole; aminocarbazoles; aminoindoles; aminopyrroles; amino-indazolinones; aminomercaptotriazoles; aminoperimidines; aminoalkyl imidazoles, such as 1-(2-aminoethyl) imidazole, 1-(3-aminopropyl) imidazole; and aminoalkyl morpholines, such as 4-(3-aminopropyl) morpholine. These polyamines are described in more detail in U.S. Pat. Nos. 4,863,623; and 5,075,383. Such polyamines can provide additional benefits, such as anti-wear and antioxidancy, to the final products.

The mol ratio of amine to hydrocarbyl-substituted succinic acid or anhydride can in one embodiment range from 1:1 to about 5:1. Another mol ratio of amine to hydrocarbyl-substituted succinic acid or anhydride useful herein ranges from about 1:1 to about 3:1.

The Mannich base dispersants are preferably a reaction product of an alkyl phenol, typically having a long chain alkyl substituent on the ring, with one or more aliphatic aldehydes containing from 1 to about 7 carbon atoms (especially formaldehyde and derivatives thereof), and polyamines (especially polyalkylene polyamines). Examples of Mannich condensation products, and methods for their production are described in U.S. Pat. Nos. 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

The preferred hydrocarbon sources for preparation of the Mannich polyamine dispersants are those derived from substantially saturated petroleum fractions and olefin polymers, preferably polymers of mono-olefins having from 2 to about 6 carbon atoms. The hydrocarbon source generally contains at least about 40 and preferably at least about 50 carbon atoms to provide substantial oil solubility to the dispersant. The olefin polymers having a GPC number average molecular weight between about 500 and 5,000 are preferred for reasons of easy reactivity and low cost. However, polymers of higher molecular weight can also be used.

The preferred Mannich base dispersants are Mannich base ashless dispersants formed by condensing about one molar proportion of long chain hydrocarbon-substituted phenol with from about 1 to 2.5 moles of formaldehyde and from about 0.5 to 2 moles of polyalkylene polyamine.

Polymeric polyamine dispersants suitable for reaction with acrylamides of formula (1) or (2) above are polymers containing basic amine groups and oil solubilizing groups (for example, pendant alkyl groups having at least about 8 carbon atoms). Examples of polymeric polyamine dispersants are set forth in U.S. Pat. Nos. 3,329,658; 3,449,250; 3,493,520; 3,519,565; 3,666,730; 3,687,849; and 3,702,300. The preferred polymeric polyamines are hydrocarbyl polyamines wherein the hydrocarbyl group is composed of a polyalkylene group, preferably polyisobutylene.

A particularly preferred dispersant component is a compound of the formula:

(3)

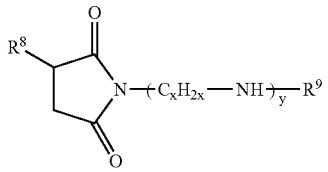

or a compound of the formula:

(4)

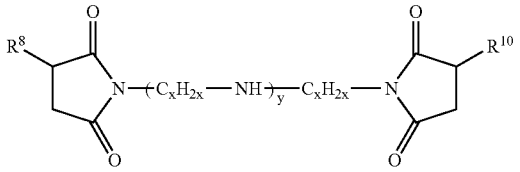

where $R^8$ and $R^{10}$ are the same or different hydrocarbyl groups, preferably polyisobutylene groups having a number average molecular weight ranging from about 500 to about 5000 as determined by gel permeation chromatography, $R^9$ is selected from H, a linear or branched alkyl or alkenyl group, an aryl group, an aralkyl group, a cycloalkyl group, and an alkaryl group, x is an integer ranging from about 1 to about 6, and y is an integer ranging from about 1 to about 10.

Modified dispersants as described herein may be made by a Michael addition reaction of the acrylamide component to the dispersant component containing a primary or secondary amine group. The amount of acrylamide component to be reacted with the dispersant component is dependent on the number of titratable nitrogen atoms in the dispersant composition. Accordingly, a molar equivalent amount of acrylamide for reaction with the dispersant preferably ranges from about 0.1n to 1n wherein n is the number of basic nitrogen atoms in the dispersant composition.

In order to modify a dispersant according to the invention, the dispersant containing at least one primary or secondary amine is heated to a temperature ranging from about 70° C. to about 170° C. under nitrogen atmosphere. The acrylamide component is then added dropwise to the heated dispersant while stirring the mixture until the desired amount of acrylamide is added to the reaction mixture. The reaction mixture is maintained at a temperature ranging from about 70° to about 170° C. for about 2 to about 6 hours. The reaction product is then diluted with process oil and filtered to provide an additive concentrate containing from about 20 to about 60 weight percent of the modified dispersant component. Modified dispersants prepared by the foregoing procedure may be represented by the following formulas:

(5)

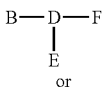

or (6)

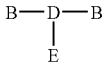

where B is selected from a hydrocarbyl-substituted succinic acid group, a reaction product of an alkyl phenol and an aldehyde, and a polyalkylene group, D is selected from an amino group and a polyamino group, F is selected from H, an alkyl or alkenyl group, an aryl group, a cycloalkyl group, an aralkyl group, an alkyaryl group, an alkyl amine group, and an aryl amine group, and E is a group derived from formula (1) above.

Particularly preferred dispersants made as described herein may be represented by the following formula:

(7)

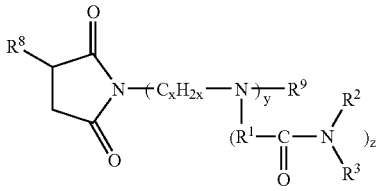

or the formula:

(8)

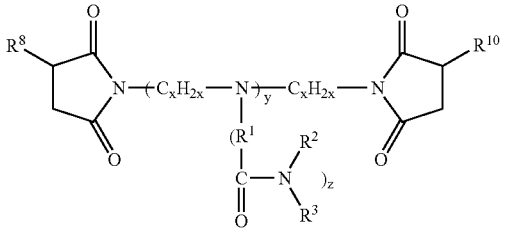

where $R^1$ is selected from an α,β-unsaturated linear or branched alkylene group, $R^2$ and $R^3$ are independently selected from H, a linear or branched alkyl or alkenyl group, an aryl group, a cycloalkyl group, an aralkyl group, an alkyaryl group, an alkyl amine group, and an aryl amine group, provided that at least one of $R^2$ and $R^3$ contain a titratable nitrogen, $R^8$ and $R^{10}$ are the same or different hydrocarbyl groups, preferably polyisobutylene groups having a number average molecular weight ranging from about 500 to about 5000 as determined by gel permeation chromatography, $R^9$ is selected from H, a linear or branched alkyl or alkenyl group, an aryl group, an aralkyl group, a cycloalkyl group, and an alkaryl group, x is an integer ranging from about 1 to about 6, y is an integer ranging from about 1 to about 10, and z is from about 0.01y to about 1.0y.

The modified dispersant as described herein is preferably provided as a concentrate in a base oil. Base oils suitable for use in formulating lubricating oil compositions may be selected from any of the synthetic or natural oils or mixtures thereof.

The base oil used which may be used to make lubricant compositions as described herein may be selected from any of the base oils in Groups I–V as specified in the American Petroleum Institute (API) Base Oil Interchangeability Guidelines. Such base oil groups are as follows:

| Base Oil Group[1] | Sulfur (wt. %) | | Saturates (wt. %) | Viscosity Index |
|---|---|---|---|---|
| Group I | >0.03 | and/or | <90 | 80 to 120 |
| Group II | ≦0.03 | And | ≧90 | 80 to 120 |

-continued

| Base Oil Group[1] | Sulfur (wt. %) | | Saturates (wt. %) | Viscosity Index |
|---|---|---|---|---|
| Group II | ≦0.03 | And | ≧90 | ≧120 |
| Group IV | all polyalphaolefins (PAOs) | | | |
| Group V | all others not included in Groups I–IV | | | |

[1]Groups I–III are mineral oil base stocks.

Another component of an additive or additive concentrate according to the embodiments described herein is a multi-functional viscosity index improver such as known in the art and are commercially available. These products and the processes for making them are taught in, for example, U.S. Pat. Nos. 4,732,942; 4,863,623; 5,075,383; 5,112,508; 5,238,588; and 6,107,257, each of which is incorporated herein by reference.

The multi-function viscosity index improver is preferably a nitrogen containing viscosity index improver. Multi-functional viscosity index improvers include the reaction product of a nitrogen or an oxygen and nitrogen containing ethylenically unsaturated, aliphatic or aromatic monomer grafted on to an olefin copolymer. Suitable nitrogen or oxygen and nitrogen containing ethylenically unsaturated monomers include N-vinyl imidazole, 1-vinyl-2-pyrrolidinone, N-allyl imidazole, allyl amines, 1-vinyl pyrrolidone, 2-vinyl pyridine, 4-vinyl pyridine, N-methyl-N-vinyl acetamide, diallyl formamide, N-methyl-N-allyl formamide, N-ethyl-N-allyl formamide, N-cyclohexyl-N-allyl formamide, 4-methyl-5-vinyl thiazole, N-allyl di-iso-octyl phenothiazine, 2-methyl-1-vinylimidazole, 3-methyl-1-vinylpyrazole, N-vinyl purine, N-vinyl piperazines, N-vinyl succinimide, vinylpiperidines, vinylmorpholines, N-arylphenylenediamines, and mixtures thereof.

The multi-functional copolymers described above, as well as processes for preparing them, are taught in U.S. Pat. Nos. 4,092,255; 4,170,561; 4,146,489; 4,715,975; 4,769,043; 4,810,754; 5,294,354; 5,523,008; 5,663,126; and 5,814,586; and 6,187,721, each of which is incorporated herein by reference.

Non-dispersant viscosity index improvers may be used in the alternative or in combination with the foregoing nitrogen containing viscosity index improvers. Such non-dispersant viscosity index improvers include, but are not limited to, olefin copolymers, polyalkylmethacrylates, and styrene-maleic esters. Of these, polyalkylmethacrylates are particularly preferred. The viscosity index improver may be supplied in the form of a solution in an inert solvent, typically a mineral oil solvent, which usually is a severely refined mineral oil.

Suitable materials for use a viscosity index improvers include styrene-maleic esters such as LUBRIZOL® 3702, LUBRIZOL® 3706 and LUBRIZOL® 3715 available from The Lubrizol Corporation; polyalkylmethacrylates such as those available from ROHM GmbH (Darmstadt, Germany) under the trade designations: VISCOPLEX® 5543, VISCOPLEX® 5548, VISCOPLEX® 5549, VISCOPLEX® 5550, VISCOPLEX® 5551 and VISCOPLEX® 5151, from Rohm & Haas Company (Philadelphia, Pa.) under the trade designations ACRYLOID® 1277, ACRYLOID® 1265 and ACRYLOID® 1269, and from Ethyl Corporation (Richmond, Va.) under the trade designation HiTEC® 5710 VII; and olefin copolymer viscosity index improvers such as HiTEC® 5747 VII, HiTEC® 5751 VII, HiTEC® 5770 VII and HiTEC® 5772 VII available from Ethyl Corporation and SHELLVIS® 200 available from Shell Chemical Company. Mixtures of the foregoing products can also be used as well as dispersant and dispersant-antioxidant viscosity index improves.

Additives used in formulating the compositions described herein may be blended into the base oil individually or in various sub-combinations. However, it is preferable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

One embodiment is directed to a method of reducing deposits in an internal combustion engine. In this embodiment, the method includes using as the crankcase lubricating oil for the internal combustion engine a lubricating oil containing the dispersant as described herein. The dispersant is present in an amount sufficient to reduce deposits in an internal combustion engine operated using the crankcase lubricating oil, as compared to deposits in an engine operated in the same manner and using the same crankcase lubricating oil, except that the oil is devoid of the dispersant. Accordingly, for reducing deposits, the modified dispersant is preferably present in the lubricating oil in an amount of from 1 to 10 weight percent based on the total weight of the oil. In other embodiments, the lubricant compositions described herein may be used or formulated as gear oils, hydraulic oils, automatic or manual transmission fluids, and the like.

The following example is given for the purpose of exemplifying aspects of the embodiments and is not intended to limit the embodiments in any way. In the following example, a lubricant containing different dispersants was used. The lubricant used for all of the runs was a blend of Group II and Group III lubricating oils, namely 50 wt. % Utra-S VHV14 Group III from S-Oils, 20 wt. % Conoco 110N Pure-Performance Group II and 30 wt. % Conoco 225N Pure-Performance Group II. The dispersant used in the following example were as follows:

"Post-treated dispersant" is a 2100 $MW_N$ PIBSA plus a polyamine post treated with nonylphenol, formaldehyde, and glycolic acid and having a SA/PIB mol ratio of greater than about 1.1.

HiTEC® 1932 dispersant is a commercially available bis-succinimide dispersant being derived from a 2100 $MW_N$ PIBSA and a polyamine having a SA/PIB ratio of greater than about 1.1, which is available from Ethyl Corporation of Richmond, Va. "PIBSA" is defined as polyisobutylene succinic acid or anhydride. The "SA/PIB" ratio is the number of moles of succinic acid or anhydride relative to the number of mols of PIB in the PIBSA adduct.

In the following table, a comparison of the properties of a modified and commercial dispersant additive having 42 wt. % active dispersant component in the base oil is provided.

| Sample No. | Activity (wt. %) | N atoms (wt. %) | Total Base Number | Concentrate Kinematic Viscosity @ 100° C. | Lubricant Kinematic Viscosity @ 100° C. |
|---|---|---|---|---|---|
| 1 | 42 | 1.03 | 23.0 | 200.0 | 10.8 |
| 2 | 42 | 1.36 | 26.4 | 173.3 | 10.6 |

In the foregoing table, sample 1 is a bis-succinimide (HiTEC® 1932) and sample 2 is a modified dispersant made by reacting the bis-succinimide of sample 1 with N,N-dimethylaminopropylmethacrylamide according to the procedure described above wherein the molar equivalents of the acrylamide were substantially equal to the molar equivalents of the succinimide dispersant. As indicated, the modified dispersant (Sample 2) had an increased percentage of nitrogen atoms in the compound and a higher base number. The viscosity of the concentrate was slightly lower, but when the concentrate was added to a finished lubricant at a concentration of 4.5 wt. %, the kinematic viscosity was only slightly lower.

Dispersant samples were prepared for Sequence VG engine testing, and blended into a SAE 5W30 lubricating oil. In the following table, the sludge containing properties of the post-treated dispersant as described above, a commercially available dispersant, and a modified dispersant according to an embodiment described herein were compared in an industry dispersant sludge test, Sequence VG engine test to determine the average engine sludge (AES). The Sequence VG engine sludge and varnish deposit test is a fired engine-dynamometer test that evaluates the ability of a lubricant to minimize the formation of sludge and varnish deposits. The test is a replacement for the Sequence VE test (ASTM D 5302). The test method was a cyclic test, with a total running duration of 216 hours, consisting of 54 cycles of 4 hours each. The test engine was a Ford 4.6L, spark ignition, four stroke, eight cylinder "V" configuration engine. Features of this engine include dual overhead camshafts, a cross-flow fast burn cylinder head design, two valves per cylinder, and electronic port fuel injection. A 90-minute break-in schedule was conducted prior to each test, since a new engine build is used for each test. Upon test completion, the engine was disassembled and rated for sludge. Average engine sludge was calculated for each sample. The modified dispersant was the same as described above and the conventional dispersant was a bis-succinimide as described above.

| Additive component | Average Engine Sludge Rating (AES) |
|---|---|
| Modified HiTEC ® 1932 dispersant | 8.29 |
| Post-treated dispersant | 7.20 |
| HiTEC ® 1932 dispersant | 8.07 |

According to the foregoing example, the modified dispersant according to the invention provided an AES rating that was about 15% higher than the rating obtained with a post-treated dispersant wherein the bis-succinimide is reacted with an oxygen-containing compound rather than an acrylamide compound. As compared to a commercially available dispersant, HiTEC® 1932 dispersant, the modified dispersant according to the disclosed embodiments had a sludge rating that was about 3% higher. The higher the AES rating the better the sludge handling capability of the lubricant. A rating above 7.2 is a pass rating for the Sequence VG engine test.

At numerous places throughout this specification, reference has been made to a number of U.S. Patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A dispersant composition comprising a reaction product of (1) an acrylamide comprised of a compound of the formula:

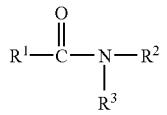

where $R^1$ is selected from an α,β-unsaturated linear or branched alkylene group, and $R^2$ and $R^3$ are independently selected from H, a linear or branched alkyl or alkenyl group, an aryl group, a cycloalkyl group, an aralkyl group, an alkyaryl group, an alkyl amine group, and an aryl amine group, provided that at least one of $R^2$ and $R^3$ contain a titratable nitrogen; and (2) a compound having at least one primary or secondary amine group and being selected from the group consisting of hydrocarbyl-substituted succinimides, hydrocarbyl-substituted amines, and Mannich base adducts derived from hydrocarbyl-substituted phenols condensed with aldehydes and amines, wherein the hydrocarbyl substituent has a number average molecular weight ranging from about 500 to about 5000 as determined by gel permeation chromatography.

2. The dispersant composition of claim 1 wherein the compound comprises a hydrocarbyl-substituted succinimide derived from a polyalkylene group and succinic acid having a ratio of succinic acid or anhydride to olefin ranging from about 0.5:1.0 to about 5:1.

3. The dispersant composition of claim 1 wherein the compound comprises a Mannich adduct derived from hydrocarbyl-substituted phenols, formaldehydes and polyethylene polyamines.

4. The dispersant composition of claim 1 wherein the compound comprises a polyalkylene polyamine.

5. The dispersant composition of claim 1 further comprising a nitrogen containing viscosity index improver that is a reaction product of a monomer and an olefin copolymer, the monomer being selected from the group consisting of N-vinyl imidazole, 1-vinyl-2-pyrrolidinone, N-allyl imidazole, allyl amines, 1-vinyl pyrrolidone, 2-vinyl pyridine, 4-vinyl pyridine, N-methyl-N-vinyl acetamide, diallyl formamide, N-methyl-N-allyl formamide, N-ethyl-N-allyl formamide, N-cyclohexyl-N-allyl formamide, 4-methyl-5-vinyl thiazole, N-allyl di-iso-octyl phenothiazine, 2-methyl-1-vinylimidazole, 3-methyl-1-vinylpyrazole, N-vinyl purine, N-vinyl piperazines, N-vinyl succinimide, vinylpiperidines, vinylmorpholines, N-arylphenylenediamines, and mixtures thereof.

6. The dispersant composition of claim 5 further comprising a non-dispersant viscosity index improver selected from the group consisting of olefin copolymers, polyalkylmethacrylates; and styrene-maleic esters.

7. The dispersant composition of claim 1 further comprising a non-dispersant viscosity index improver selected from the group consisting of olefin copolymers, polyalkylmethacrylates, and styrene-maleic esters.

8. A lubricant composition comprising an oil of lubricating viscosity and from about 0.1 to 10 wt. %, based on the total weight of the lubricant composition, of the dispersant composition of claim 1.

9. A vehicle having moving parts and containing a lubricant for lubricating the moving parts, the lubricant comprising an oil of lubricating viscosity and from about 0.1 to 10 wt. %, based on the total weight of the lubricant composition, of the dispersant of claim 1.

10. A lubricant additive comprising, a first dispersant and a second dispersant selected from the group consisting of hydrocarbyl-substituted succinimides, hydrocarbyl-substituted amines, and Mannich base adducts derived from hydrocarbyl-substituted phenols condensed with aldehydes and amines, wherein the first dispersant is the dispersant composition of claim 1.

11. The lubricant additive of claim 10 further comprising a nitrogen containing viscosity index improver that is a reaction product of a monomer and an olefin copolymer, the monomer being selected from the group consisting of N-vinyl imidazole, 1-vinyl-2-pyrrolidinone, N-allyl imidazole, allyl amines, 1-vinyl pyrrolidone, 2-vinyl pyridine, 4-vinyl pyridine, N-methyl-N-vinyl acetamide, diallyl formamide, N-methyl-N-allyl formamide, N-ethyl-N-allyl formamide, N-cyclohexyl-N-allyl formamide, 4-methyl-5-vinyl thiazole, N-allyl di-iso-octyl phenothiazine, 2-methyl-1-vinylimidazole, 3-methyl-1-vinylpyrazole, N-vinyl purine, N-vinyl piperazines, N-vinyl succinimide, vinylpiperidines, vinylmorpholines, N-arylphenylenediamines, and mixtures thereof.

12. The lubricant additive of claim 11 further comprising a non-dispersant viscosity index improver selected from the group consisting of olefin copolymers, polyalkylmethacrylates, and styrene-maleic esters.

13. The lubricant additive of claim 10 further comprising a non-dispersant viscosity index improver selected from the group consisting of olefin copolymers polyalkylmethacrylates, and styrene-maleic esters.

14. A lubricant composition comprising an oil of lubricating viscosity and from about 0.1 to 10 wt. %, based on the total weight of the lubricant composition, of the lubricant additive of claim 10.

15. A lubricant additive comprising a reaction product of (1) an acrylamide comprised of a compound of the formula:

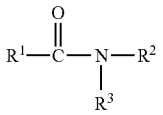

where $R^1$ is selected from an α,β-unsaturated linear or branched alkylene group, and $R^2$ and $R^3$ are independently selected from H, a linear or branched alkyl or alkenyl group, an aryl group, a cycloalkyl group, an aralkyl group, an alkyaryl group, an alkyl amine group, and an aryl amine group, provided that at least one of $R^2$ and $R^3$ contain a titratable nitrogen; and (2) a dispersant having at least one primary or secondary amine group and being selected from the group consisting of hydrocarbyl-substituted succinimides, hydrocarbyl-substituted amines, and Mannich base adducts derived from hydrocarbyl-substituted phenols condensed with aldehydes and amines, wherein the hydrocarbyl-substituent has a number average molecular weight ranging from about 500 to about 5000 as determined by gel permeation chromatography.

16. The lubricant additive of claim 15 wherein the dispersant comprises a hydrocarbyl-substituted succinimide derived from a polyalkylene group and succinic acid having a ratio of polyalkylene group to succinic acid ranging from about 0.8:1.0 to about 3:1.

17. The lubricant additive of claim 15 wherein the dispersant comprises a Mannich adduct derived from hydrocarbyl-substituted phenols, formaldehydes and polyethylene polyamines.

18. The lubricant additive of claim 15 wherein the dispersant comprises a polyalkylene polyamine.

19. The lubricant additive of claim 15 further comprising a nitrogen containing viscosity index improver that is a reaction product of a monomer and an olefin copolymer, the monomer being selected from the group consisting of N-vinyl imidazole, 1-vinyl-2-pyrrolidinone, N-allyl imidazole, allyl amines, 1-vinyl pyrrolidone, 2-vinyl pyridine, 4-vinyl pyridine, N-methyl-N-vinyl acetamide, diallyl formamide, N-methyl-N-allyl formamide, N-ethyl-N-allyl formamide, N-cyclohexyl-N-allyl formamide, 4-methyl-5-vinyl thiazole, N-allyl di-iso-octyl phenothiazine, 2-methyl-1-vinylimidazole, 3-methyl-1-vinylpyrazole, N-vinyl purine, N-vinyl piperazines, N-vinyl succinimide, vinylpiperidines, vinylmorpholines, N-arylphenylenediamines, and mixtures thereof.

20. The lubricant additive of claim 15 further comprising a non-dispersant viscosity index improver selected from the group consisting of olefin copolymers, polyalkylmethacrylates, and styrene-maleic esters.

21. A lubricant composition comprising an oil of lubricating viscosity and from about 0.1 to 10 wt. %, based on the total weight of the lubricant compositions, of the lubricant additive of claim 15.

22. A method of lubricating moving parts of a vehicle containing one or more moving parts, the method comprising contacting a lubricating oil with the one or more moving parts of the vehicle, said oil comprising a lubricant composition containing a lubricant and a lubricant additive, the lubricant additive including a reaction product of (1) an acrylamide comprised of a compound of the formula:

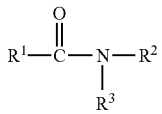

where $R^1$ is selected from an α,β-unsaturated linear or branched alkylene group, and $R^2$ and $R^3$ are independently selected from H, a linear or branched alkyl or alkenyl group, an aryl group, a cycloalkyl group, an aralkyl group, an alkyaryl group, an alkyl amine group, and an aryl amine group, provided that at least one of $R^2$ and $R^3$ contain a titratable nitrogen; and (2) a dispersant having at least one primary or secondary amine group and being selected from the group consisting of hydrocarbyl-substituted succinimides, hydrocarbyl-substituted amines, and Mannich base adducts derived from hydrocarbyl-substituted phenols condensed with aldehydes and amines, wherein the hydrocarbyl substituent has a number average molecular weight ranging from about 500 to about 5000 as determined by gel permeation chromatography, and wherein the lubricant additive is present in the lubricant composition in an amount sufficient to lubricate the one or more moving parts of the vehicle.

23. The method of claim 22 wherein the vehicle includes an internal combustion engine having a crankcase and wherein the lubricant composition comprises a crankcase oil present in the crankcase of the vehicle.

24. The method of claim 22 wherein the lubricant composition comprises a drive train lubricant present in an automotive drive train of the vehicle.

25. The method of claim 22 wherein the lubricant additive includes a nitrogen containing viscosity index improver that is a reaction product of a monomer and an olefin copolymer, the monomer being selected from the group consisting of N-vinyl imidazole, 1-vinyl-2-pyrrolidinone, N-allyl imidazole, allyl amines, 1-vinyl pyrrolidone, 2-vinyl pyridine, 4-vinyl pyridine, N-methyl-N-vinyl acetamide, diallyl formamide, N-methyl-N-allyl formamide, N-ethyl-N-allyl formamide, N-cyclohexyl-N-allyl formamide, 4-methyl-5-vinyl thiazole, N-allyl di-iso-octyl phenothiazine, 2-methyl-1-vinylimidazole, 3-methyl-1-vinylpyrazole, N-vinyl purine, N-vinyl piperazines, N-vinyl succinimide, vinyl piperidines, vinylmorpholines, N-arylphenylenediamines, and mixtures thereof.

26. The method of claim 25 further comprising a non-dispersant viscosity index improver selected from the group consisting of olefin copolymers, polyalkylmethacrylates, and styrene-maleic esters.

27. The method of claim 22 further comprising a non-dispersant viscosity index improver selected from the group consisting of olefin copolymers, polyalkylmethacrylates, and styrene-maleic esters.

28. A composition for use as a dispersant comprising a compound of the formula:

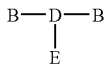

where B is selected from a hydrocarbyl-substituted succinic acid group, a reaction product of an alkyl phenol and an aldehyde, and a polyalkylene group, D is selected from an amine and a polyamine, and E is a group derived from a compound of the formula:

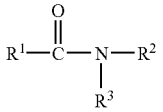

where $R^1$ is selected form an α,β-unsaturated linear or branched alkylene group, and $R^2$ and $R^3$ are independently selected from H, a linear or branched alkyl or alkenyl group, an aryl group, a cycloalkyl group, an aralkyl group, an alkyaryl group, an alkyl amine group, and an aryl amine group, provided that at least one of $R^2$ and $R^3$ contain a titratable nitrogen.

29. The composition of claim 28 wherein E is a group derived from a compound of the formula:

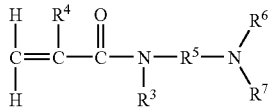

where $R^4$ is selected from H, and an alkyl group containing from 1 to 4 carbon atoms, $R^3$ is selected from H, a linear or branched alkyl or alkenyl group, and an aryl group, $R^5$ is selected from an alkylene group, an aralkylene group, a cycloalkylene group, an arylene group, and an alkarylene group, and $R^6$ and $R^7$ are independently selected from H, a linear or branched alkyl or alkenyl group, an aryl group, an aralkyl group, a cycloalkyl group, and an alkaryl group.

30. The composition of claim 28 wherein the compound is selected from the group consisting of:

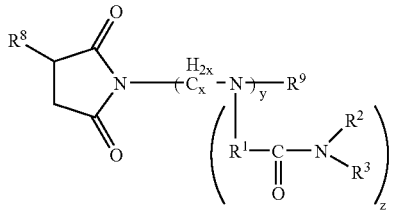

and

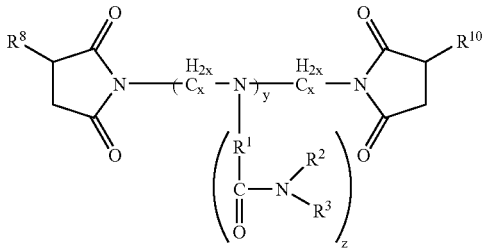

where $R^1$ is selected from an α,β-unsaturated linear or branched alkylene group, $R^2$ and $R^3$ are independently selected from H, an alkyl group, an aryl group, a cycloalkyl group, an aralkyl group, an alkyaryl group, an alkyl amine group, and an aryl amine group, provided that at least one of $R^2$ and $R^3$ contain a titratable nitrogen, $R^8$ and $R^{10}$ are the same or different hydrocarbyl groups, $R^9$ is selected from H, a linear or branched alkyl or alkenyl group, an aryl group, an aralkyl group, a cycloalkyl group, and an alkaryl group, x is an integer ranging from about 1 to about 6, y is an integer ranging from about 1 to about 10, and z is from about 0.1y to about 1.0y.

31. The composition of claim 30 wherein $R^8$ and $R^{10}$ comprise polyisobutylene having a number average molecular weight ranging from about 500 to about 5000 as determined by gel permeation chromatography.

* * * * *